US008662706B2

(12) United States Patent
Komatsu

(10) Patent No.: US 8,662,706 B2
(45) Date of Patent: Mar. 4, 2014

(54) LAMP UNIT

(75) Inventor: Motohiro Komatsu, Shizuoka (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 0 days.

(21) Appl. No.: 13/292,165

(22) Filed: Nov. 9, 2011

(65) Prior Publication Data

US 2012/0127712 A1 May 24, 2012

(30) Foreign Application Priority Data

Nov. 18, 2010 (JP) ..... 2010-257800

(51) Int. Cl.
*F21S 4/00* (2006.01)

(52) U.S. Cl.
USPC ..... 362/249.05; 362/245; 362/247; 362/516; 362/517; 362/543

(58) Field of Classification Search
USPC ..... 362/509, 516, 517, 543–545, 245, 247, 362/249.05
See application file for complete search history.

(56) References Cited

U.S. PATENT DOCUMENTS

| | | | | |
|---|---|---|---|---|
| 2004/0170014 | A1* | 9/2004 | Pritchard et al. | 362/202 |
| 2006/0044840 | A1* | 3/2006 | Watanabe et al. | 362/647 |
| 2008/0247170 | A1 | 10/2008 | Peck | |

FOREIGN PATENT DOCUMENTS

| | | | |
|---|---|---|---|
| CN | 101356858 | A | 1/2009 |
| CN | 101828069 | A | 9/2010 |
| JP | 2008-10228 | A | 1/2008 |
| JP | 4431932 | B2 | 1/2010 |
| JP | 201040528 | A | 2/2010 |
| JP | 2010527112 | A | 8/2010 |

OTHER PUBLICATIONS

Communication dated Jan. 8, 2013 from the Korean Intellectual Property Office in counterpart Korean application No. 10-2011-0120164.

Office Action dated Dec. 13, 2013 issued by the State Intellectual Property Office of P.R. China in corresponding Chinese Patent Application No. 201110374853.8.

* cited by examiner

*Primary Examiner* — Stephen F Husar
*Assistant Examiner* — Meghan Dunwiddie
(74) *Attorney, Agent, or Firm* — Sughrue Mion, PLLC

(57) ABSTRACT

A lamp unit includes: a light source array including a plurality of light sources aligned into an array; a mount portion on which the light source array is to be mounted; a first reflecting mirror configured to reflect light from the light sources, wherein the first reflecting mirror is parabolic cylindrical or hyperbolic cylindrical and is provided at least either above and below the light source array; and an optical member configured to project direct light from the light sources and reflected light from the first reflecting mirror to the front.

19 Claims, 9 Drawing Sheets

LAMP UNIT

CROSS REFERENCE TO RELATED APPLICATION(S)

The present disclosure relates to the subject matters contained in Japanese Patent Application No. 2010-257800 filed on Nov. 18, 2010, which are incorporated herein by reference in its entirety.

FIELD

An exemplary embodiment of the present invention relates to a lamp unit provided in a vehicle headlamp.

BACKGROUND

There have been known lamp units which employ a light source unit in which a plurality of semiconductor light emitting elements such as LEDs are disposed into an array (see JP-A-2008-10228, for instance). In the lamp units, a plurality of light distribution patterns can be formed by controlling individually the semiconductor light emitting elements to be turned on and off.

The lamp units described above tend to increase the production costs due to using a number of semiconductor light emitting elements.

SUMMARY

The invention has been made in view of these situations and an object thereof is to provide an inexpensive lamp unit.

According to an aspect of the invention, there is provided a lamp unit including: a light source array including a plurality of light sources aligned into an array; a mount portion on which the light source array is to be mounted; a first reflecting mirror configured to reflect light from the light sources, wherein the first reflecting mirror is parabolic cylindrical or hyperbolic cylindrical and is provided at least either above and below the light source array; and an optical member configured to project direct light from the light sources and reflected light from the first reflecting mirror to the front.

According to this aspect, by providing the reflecting mirror at least above or below the light source array, the lamp unit can be attained which can ensure a wide illumination area with a smaller number of light sources. Since the number of light sources is small, the inexpensive lamp unit can be realized.

The lamp unit may further include a second reflecting mirror configured to reflect light from the light sources, wherein the second reflecting mirror is provided to at least either the left and right of the light source array.

The light source array may be formed so that the number of light sources which are disposed in a vertical direction therein becomes largest near a center in a horizontal direction thereof.

The light source array may be configured to be turned on and off with respect to each of the light sources.

According to the invention, the inexpensive lamp unit can be provided.

BRIEF DESCRIPTION OF THE DRAWINGS

A general configuration that implements the various features of the invention will be described with reference to the drawings. The drawings and the associated descriptions are provided to illustrate embodiments of the invention and should not limit the scope of the invention.

DETAILED DESCRIPTION OF THE EMBODIMENTS

Hereinafter, an embodiment of the invention will be described in detail by reference to the drawings.

Figure 1:
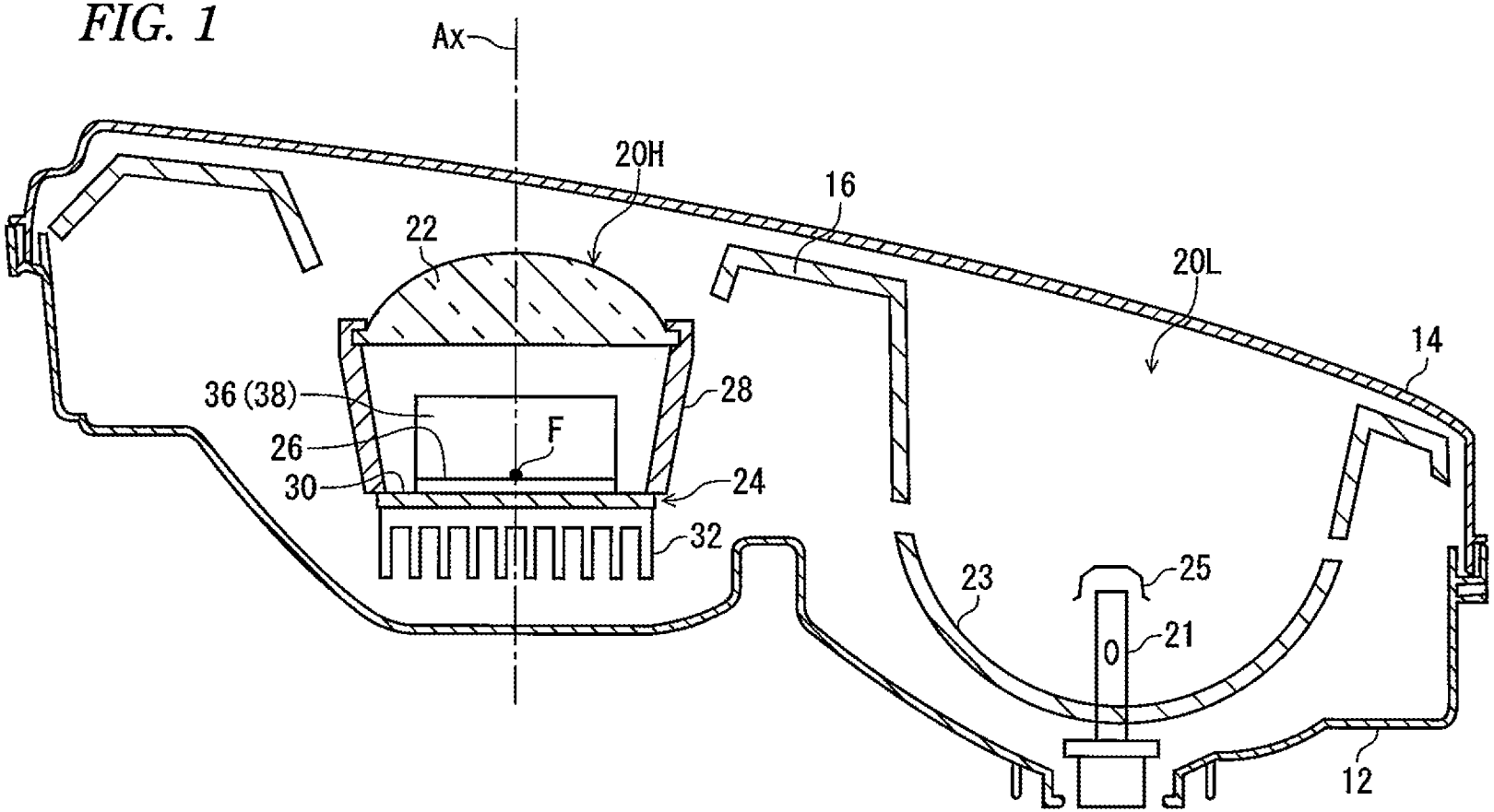
FIG. 1 is a schematic horizontal sectional view of a vehicle headlamp which employs a lamp unit according to an embodiment of the invention.

FIG. 1 is a schematic horizontal sectional view of a vehicle headlamp 10 which employs a lamp unit according to an embodiment of the invention.

The vehicle headlamp 10 according this embodiment includes a low-beam lamp unit 20L and a high-beam lamp unit 20H which are accommodated in a lamp compartment which is made up of a lamp body 12 and a transparent cover 14 which is attached to a front end opening portion of the lamp body 12. The low-beam lamp unit 20L and the high-beam lamp unit 20H are mounted on the lamp body 12 by corresponding support member 16 is fixed to the lamp body 12 or the transparent cover 14 so as to cover an area defined between the front side opening portion of the lamp body 12 and the lamp units with respect to the front. This extension member 16 has opening portions in respective areas which correspond to the lamp units.

The low-beam lamp unit 20L is a conventionally known reflection-type lamp and has a light source bulb 21 and a reflector 23. The low-beam lamp unit 20L forms a low-beam light distribution pattern having a predetermined cut-off line by reflecting light emitted from the light source bulb 21 by the reflector 23 and cutting off part of light directed to the front from the reflector 23 with a shield plate, not shown. A shade 25 is provided at a distal end of the light source bulb 21 for cutting off light emitted directly to the front from the light source bulb 21. The shape of the low-beam lamp unit 20L is not limited thereto, and hence, the low-beam lamp unit 20L may be a projector-type lamp unit similar to the high-beam lamp unit 20H, which will be described below.

The high-beam lamp unit 20H is a projector-type lamp unit and has a projection lens 22, a light source unit including an LED array 26 in which a plurality of LEDs are aligned into an array and a holder 28 which holds the projection lens 22 and the light source unit 24. The projection lens is a planoconvex aspherical lens which is convex on a front surface and is plane on a rear surface and is disposed on an optical axis Ax which extends in a front-to-rear or longitudinal direction of the vehicle. The projection lens 22 is made to project an image on a rear focal plane which includes a rear focal point F thereof on to a vertical imaginary screen which is disposed ahead of the lamp unit as an inverted image. The projection lens 22 is held in an annular groove portion at a front end of the holder 28 at a circumferential edge portion thereof.

The light source unit 24 is fixedly provided at a rear end side of the holder 28 in such a state that the LED array 26 is disposed further rearwards than the rear focal point F of the projection lens 22.

The light source unit 24 includes the LED array 26, a mount plate 30 where the LED array 26 is mounted, an upper reflecting mirror 36 and a lower reflecting mirror 38 which are fixed to the mount plate 30 and a heat dissipating plate 32 which dissipates heat emitted from the LED array 26. The LED array 26 is fixed to a front surface of the mount plate 30 so that a light emitting surface thereof is oriented to the front with respect to the direction of the optical axis Ax. The center of the LED array 26 is positioned on the optical axis Ax. The heat dissipating plate 32 is fixed to a rear surface of the mount plate 30.

Figure 2:
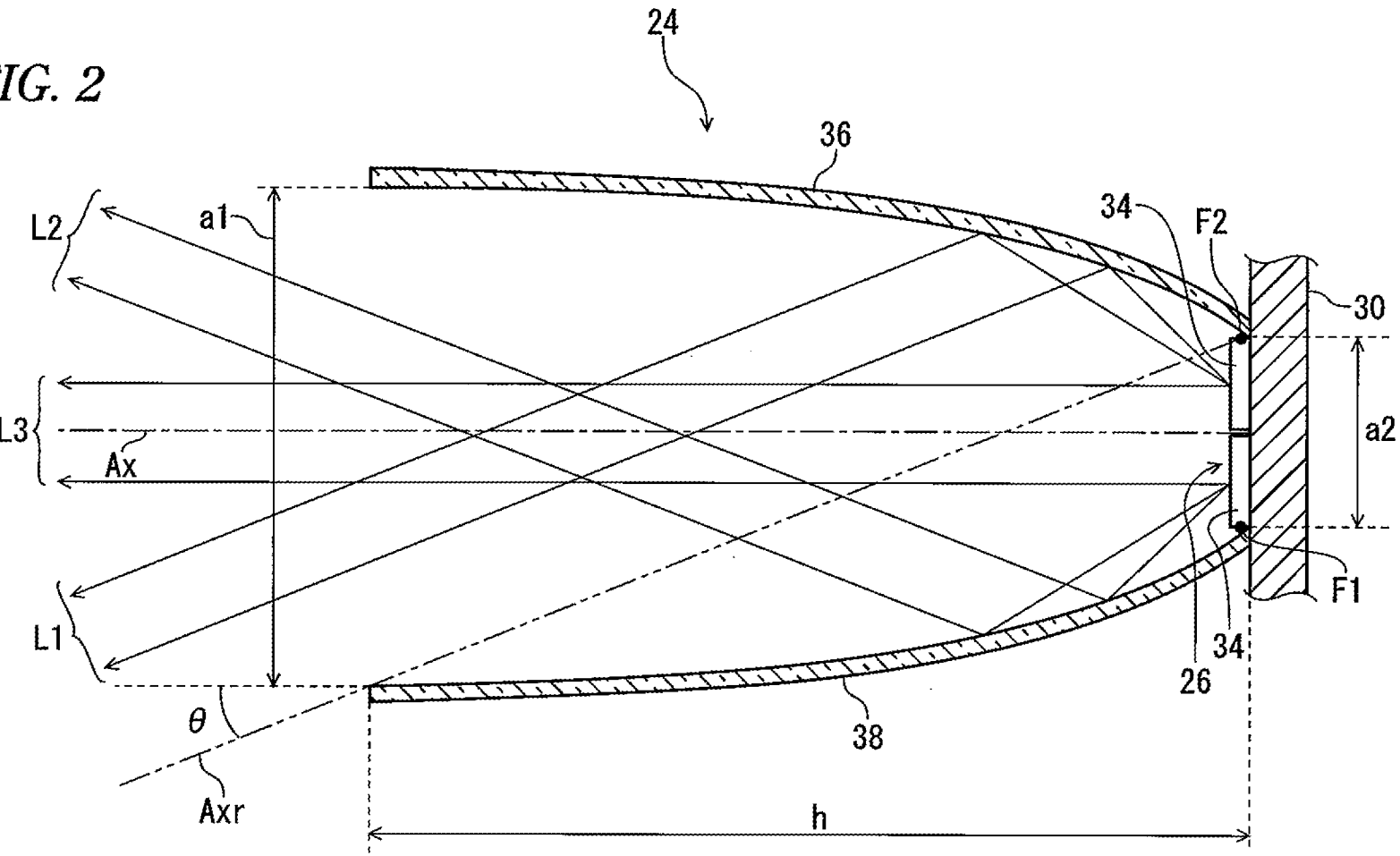
FIG. 2 is a schematic vertical sectional view of a light source unit.
Figure 3:
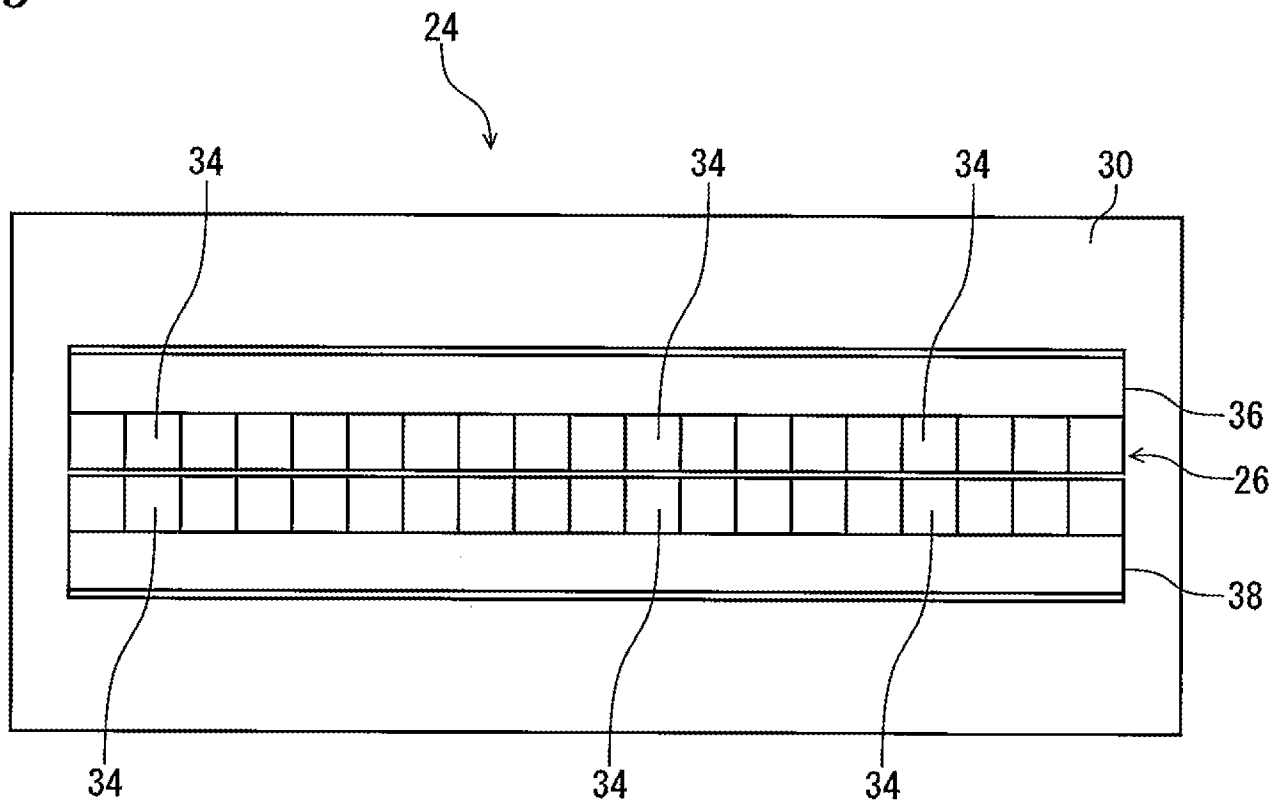
FIG. 3 is a front view of the light source unit.

FIG. 2 is a schematic vertical sectional view of the light source unit 24. In addition, FIG. 3 is a front view of the light source unit 24. In FIG. 2, the illustration of the heat dissipating plate 32 is omitted.

As is shown in FIGS. 2 and 3, the light source unit 24 includes the LED array 26 in which 38 square LEDs 34 are arranged into an array, the upper reflecting mirror 36 which is provided above the LED array 26, and the lower reflecting mirror 38 which is provided below the LED array 26.

As is shown in FIG. 3, the LED array 26 is configured so that 38 LEDs 34 are arranged into a matrix of two rows of LEDs each including 19 LEDs. Each LED 34 is fixed to the mount plate 30. In addition, each LED 34 is controlled to be turned on and off by a control unit, not shown.

The upper reflecting mirror 36 and the lower reflecting mirror 38 are each a parabolic cylindrical reflecting mirror. Reflecting surfaces of the upper reflecting mirror 36 and the lower reflecting mirror 38 are each formed by use of part of a surface of the parabolic cylinder. A transverse length of each of the upper reflecting mirror 36 and the lower reflecting mirror 38 is formed so as to be at least not less than a transverse length of the LED array 26. The upper reflecting mirror 36 and the lower reflecting mirror 38 reflect light from the LEDs 34 towards the projection lens 22. FIG. 2 shows light L1 which is emitted from the LEDs 34 and is then reflected by the upper reflecting mirror 36 and light L2 which is emitted from the LEDs 34 and is then reflected by the lower reflecting mirror 38. The light L1 and light L2 are emitted from the light source unit 24 and are than incident on the projection lens 22. In addition, part of light emitted from the LEDs 34 is directly incident on the projection lens 22 without being reflected on the upper to reflecting mirror 36 and the lower reflecting mirror 38 (the light being shown as light L3 in FIG. 2). Consequently, the projection lens 22 project direct light from the LEDs 34 and reflected light reflected on the upper reflecting mirror 36 and the lower reflecting mirror 38 to the front of the lamp.

The upper reflecting mirror 36 and the lower reflecting mirror 38 will be described in greater detail by use of FIG. 2. As is shown in FIG. 2, a rear end portion of the upper reflecting mirror 36 is in abutment with an upper end portion of the LED array 26. In addition, a rear end portion of the lower reflecting mirror 38 is in abutment with a lower end portion of the LED array 26. Further, the upper reflecting mirror 36 is disposed so that a focal point F1 of the parabolic surface is situated at the lower end reflecting mirror 38 is disposed so that a focal point F2 of the parabolic surface is situated at the upper end of the LED array 26. The upper reflecting mirror 36 and the lower reflecting mirror 38 are disposed symmetrical with each other with respect to a horizontal plane which includes an optical axis of the light source unit 24.

As is shown in FIG. 2, assuming that a distance between a distal end portion of the upper reflecting mirror 36 and a distal end portion of the lower reflecting mirror 38 is a1, a distance between the rear end portion of the upper reflecting mirror 36 and the rear end portion of the lower reflecting mirror 38 is a2, a distance from the distal end portion of the upper reflecting mirror (or the lower reflecting mirror 38) to the rear end portion of the upper reflecting mirror 36 (or the lower reflecting mirror 38) is h, and an angle formed by the optical axis Ax of the light source unit 24 and an optical axis Axr of the upper reflecting mirror 36 (or the lower reflecting mirror 38) is θ. Then, relationships represented by the following expressions (1) and (2) are established between the parameters a1, a2, h and θ.

$$a1/a2=1/\sin\theta \quad (1)$$

$$h=a1\times(1+\sin\theta)/2\tan\theta \quad (2)$$

FIGS. 4A to 4D show light distribution patterns which are formed by the high-beam lamp unit. FIGS. 4A to 4D show the high-beam light distribution patterns which are formed on an imaginary vertical screen disposed in a position 25*m* ahead of the vehicle by light emitted from the high-beam lamp unit.

Figure 4A:
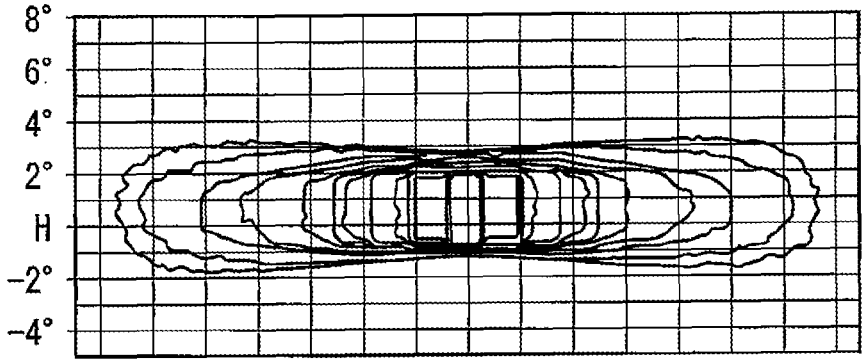
FIGS. 4A to 4D show light distribution patterns formed by a high-beam lamp unit.

FIG. 4A shows, as a comparison example, a high-beam light distribution pattern which is formed by a high-beam lamp unit using a light source unit which is realized by removing the upper reflecting mirror 36 and the lower reflecting mirror 38 from the light source unit 24 shown in FIG. 2. A vertical width of this high-beam light distribution pattern is defined as lying from about 3 degree to about −1.5 degree.

Figure 4B:
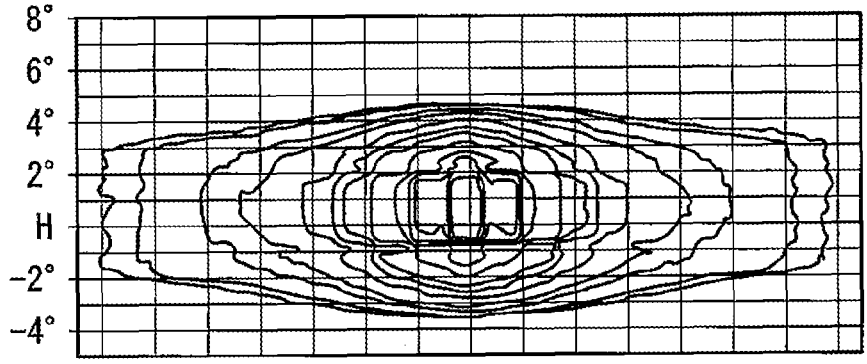

FIG. 4B shows a high-beam light distribution pattern which is formed by the high-beam lamp unit 20H according to the embodiment shown in FIG. 1. A vertical width of this high-beam light distribution pattern is defined as lying from about 4.5 degree to about −3.5 degree. It is seen that the illumination range of the high-beam light distribution pattern is increased, compared with the high-beam light distribution pattern shown in FIG. 4A.

Figure 4C:
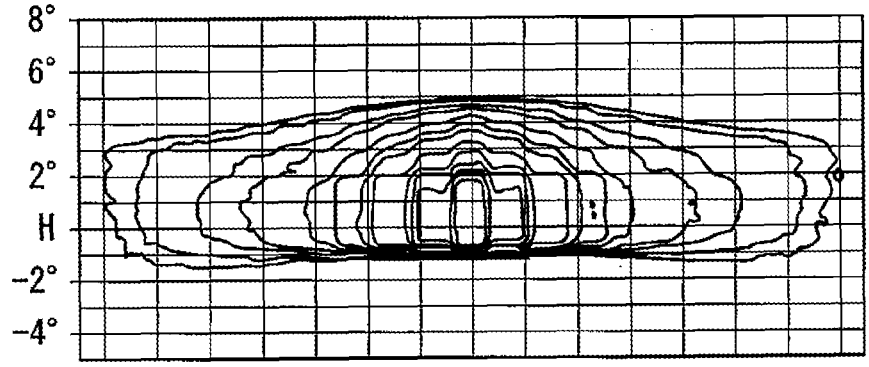

FIG. 4C shows a high-beam light distribution pattern which is formed by a high-beam lamp unit which employs a light source unit which is realized by removing the upper reflecting mirror 36 from the light source unit 24 shown in FIG. 2 so as to allow only the lower reflecting mirror 38 to remain thereon. A vertical width of this high-beam light distribution pattern is defined as lying from about degree to about −1.5 degree. It is seen that the illumination range is increased by a vertical width above a horizontal line H by the lower reflecting mirror 38, compared with the high-beam light distribution pattern shown in FIG. 4A.

Figure 4D:
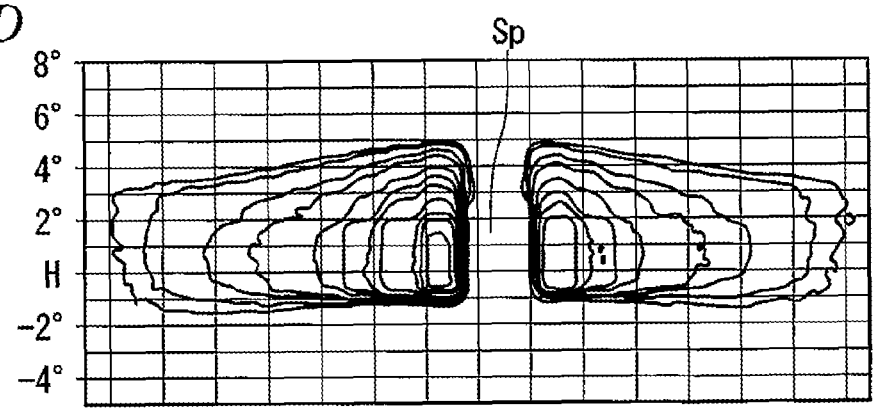

FIG. 4D shows a light distribution pattern which is formed by a high-beam lamp unit similar to that used to form the light distribution pattern shown in FIG. 4C in which four LEDs 34 situated near the optical axis Ax are turned off and the remaining LEDs 34 are turned on. This light distribution pattern is referred to as a so-called "split light distribution pattern" which is a light distribution pattern in which a split area Sp on to which light is not shone is provided in part of the high-beam light distribution pattern. The split light distribution pattern is a light distribution pattern in which visibility outside the subject vehicle's lane and the oncoming vehicles' lane cab be ensured in a good condition while suppressing the shining of light on to the subject vehicle's lane and the oncoming vehicles' lane. As is shown in FIG. 4D, the cut-off line of light is not formed at an upper portion of the split area Sp as clear as at pattern near the upper portion of the split area Sp is formed by the lower reflecting mirror 38. However, an area near the upper portion of the split area Sp is an area where normally neither vehicle nor pedestrian is present, and therefore, there is provided substantially little influence.

Thus, as has been described heretofore, according to the high-beam lamp unit 20H of this embodiment, by providing the upper reflecting mirror 36 and the lower reflecting mirror 38 above and below the LED array 26, respectively, compared with the configuration where there is provided only the LED array 26, the illumination range can be increased. Similarly, the illumination range can be increased also when the number of LEDs 34 in the LED array 26 is increased so that these LEDs 34 are arranged into a matrix of four vertically aligned rows each including 19 LEDs. However, in this case, the production costs are increased by the increase in the number of LEDs. According to the high-beam lamp unit 20H of the embodiment, since the increase in the number of LEDs can be suppressed, the inexpensive high-beam lamp unit can be realized while ensuring the equal illumination range.

As is shown in FIG. 1, the vehicle headlamp 10 includes the low-beam lamp unit 20L in addition to the high-beam lamp unit 20H. Consequently, when the low-beam lamp unit 20L is turned on in addition to the high-beam lamp unit 20H, the light distribution pattern shown in FIG. 4C is good enough for the light distribution pattern of the high-beam lamp unit 20H. In this case, since the upper reflecting mirror 36 can be deleted, the high-beam lamp unit can be more inexpensive.

Figure 5:
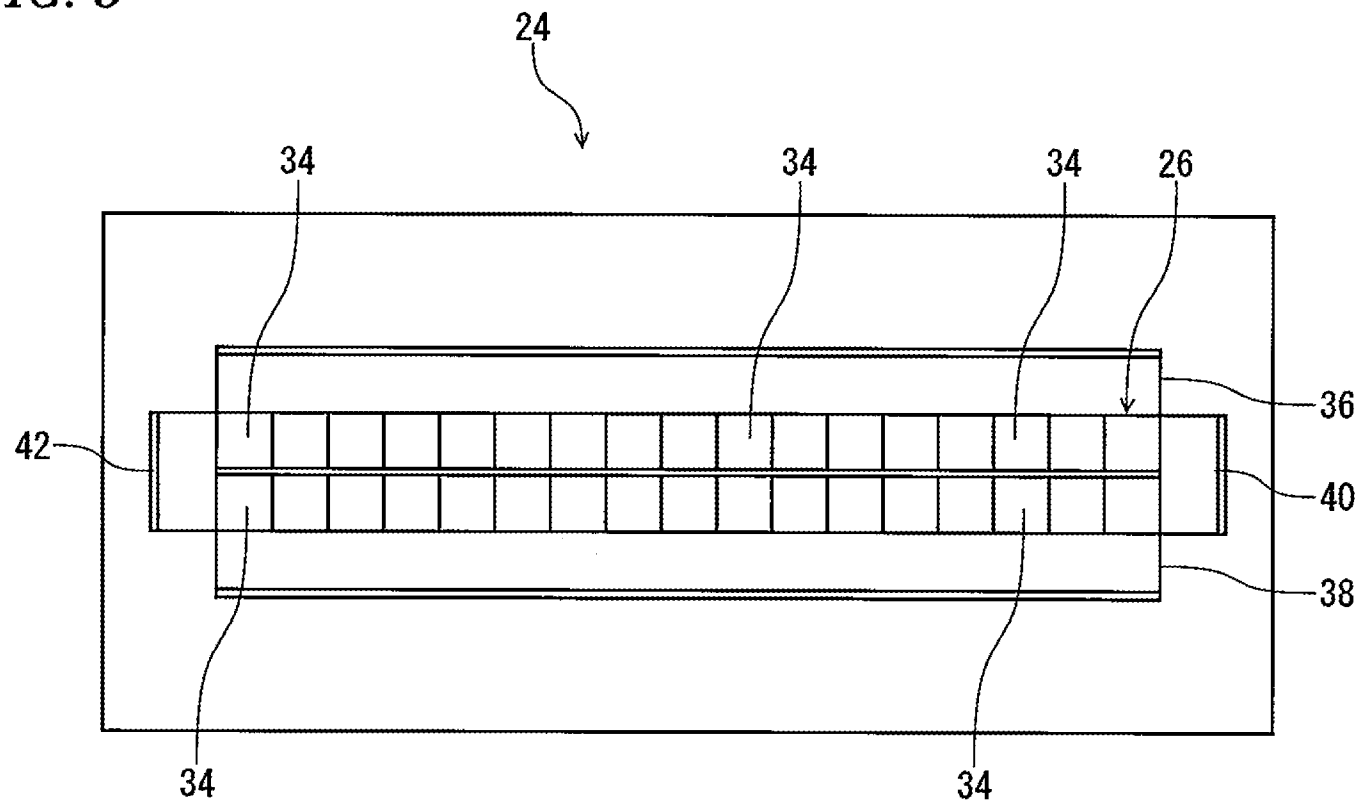
FIG. 5 is a front view of a modified example of a light source unit.

FIG. 5 shows a modified example of a light source unit. In a light source unit 24 shown in FIG. 5, an LED array 26 is formed into a matrix of two vertically aligned rows of LEDs 34 each including 17 LEDs. Namely, when compared with the light source unit shown in FIG. 3, each row includes the number of LEDs 34 which is less by two than the number of LEDs of each row of the light source unit in FIG. 3. In addition, in the light source unit 24 shown in FIG. 5, a right reflecting mirror 40 is provided to the right of the LED array 26, and a left reflecting mirror 42 is provided to the left of the LED array 26. The right reflecting mirror 40 and the left reflecting mirror 42 have a function to reflect light from the LEDs 34 so as to be incident on the projection lens.

In the high-beam lamp unit which employs the light source unit 24 shown in FIG. 5, although the number of LEDs of each row is reduced at the left and right of the LED array 26, since the right reflecting mirror 40 and the left reflecting mirror 42 are provided, an illumination area can be ensured which is almost the same as the illumination range obtained when the light source unit shown in FIG. 3 is used. In addition, since the number of LEDs 34 is reduced, the high-beam lamp unit can be much more inexpensive.

In the example shown in FIG. 5, while the reflecting mirrors are provided at the left- and right-hand sides of the LED array 26, the reflecting mirror may be provided at least either at the left-hand side or at the right-hand side of the LED array 26.

Figure 6:
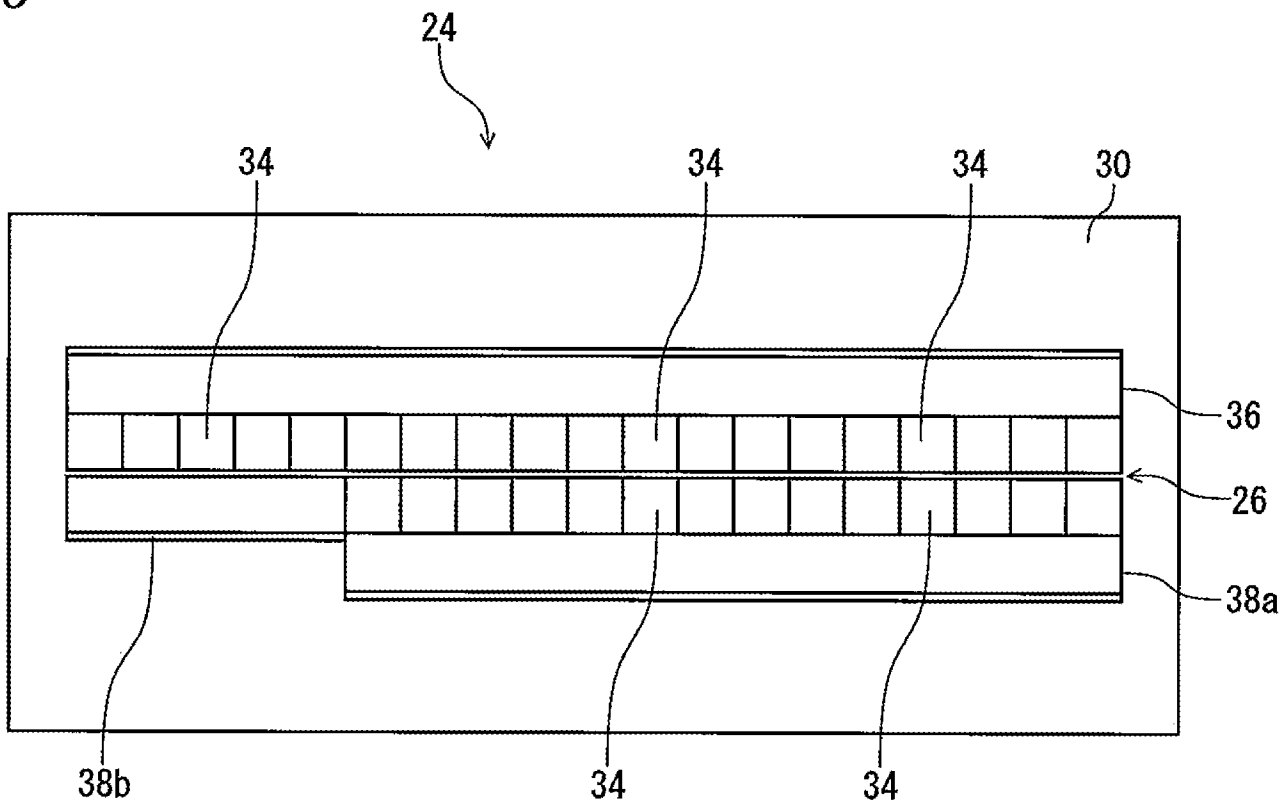
FIG. 6 is a front view of another modified example of a light source unit.

FIG. 6 also shows a modified example of a light source unit. A light source unit 24 shown in FIG. 6 has a different layout of LEDs 34 from that of the light source unit 24 shown in FIG. 3. In this modified example, one row of LEDs 34 is provided in a vertical direction at a left-hand side portion of an LED array 26, whereas two rows of LEDs 34 are provided in the vertical direction at central and right-hand side portions of the LED array 26. Then, a first lower reflecting mirror 38*a* is provided to extend below the central and right-hand side portions of the LED array 26, and a second lower reflecting mirror 38*b* is provided below the left-hand side portion of the LED array 26.

Figure 7:
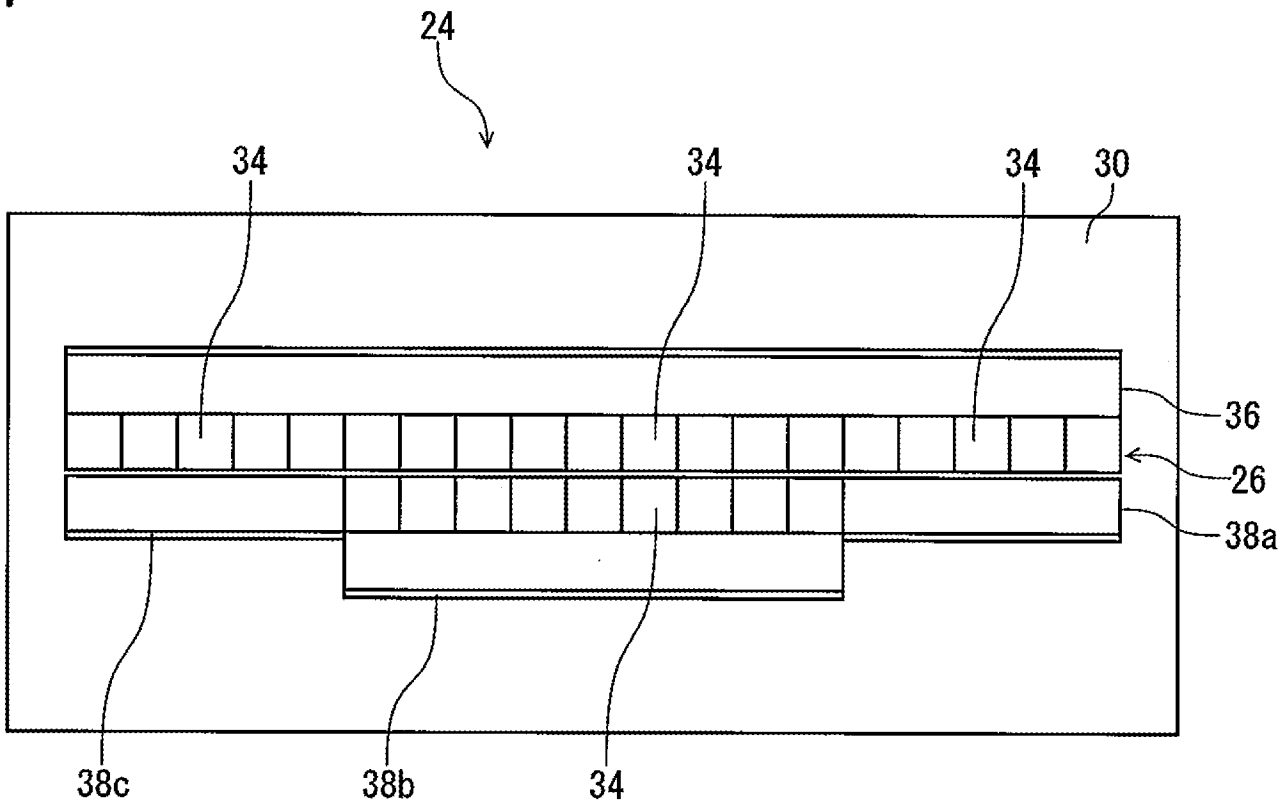
FIG. 7 is a front view of a further modified example of a light source unit.

FIG. 7 also shows a modified example of a light source unit. A light source unit 24 shown in FIG. 7 also has a different layout of LEDs 34 from that of the light source unit 24 shown in FIG. 3. In this modified example, one row of LEDs 34 is provided in a vertical direction at a left-hand side portion and a right-hand side portion of an LED array 26, and two rows of LEDs 34 are provided in the vertical direction at a central portion of the LED array 26. Then, a first lower reflecting mirror 38*a* is provided below the right-hand side portion of the LED array 26, a second reflecting mirror 38*b* is provided below the central portion of the LED array 26, and a third lower reflecting mirror 38*c* is provided below the left-hand side portion of the LED array 26.

As is shown in FIGS. 6 and 7, there is imposed no specific limitation on the layout of LEDs in the LED array 26, and hence, various layouts of LEDs can be adopted. However, it is desirable that the LED array 26 is formed so that the number of rows of LEDs provided in the vertical direction be the largest near the center in a horizontal direction of the LED array 26. This is because in a general light distribution pattern a widest illumination area is needed near the center of the light distribution pattern.

Figure 8:
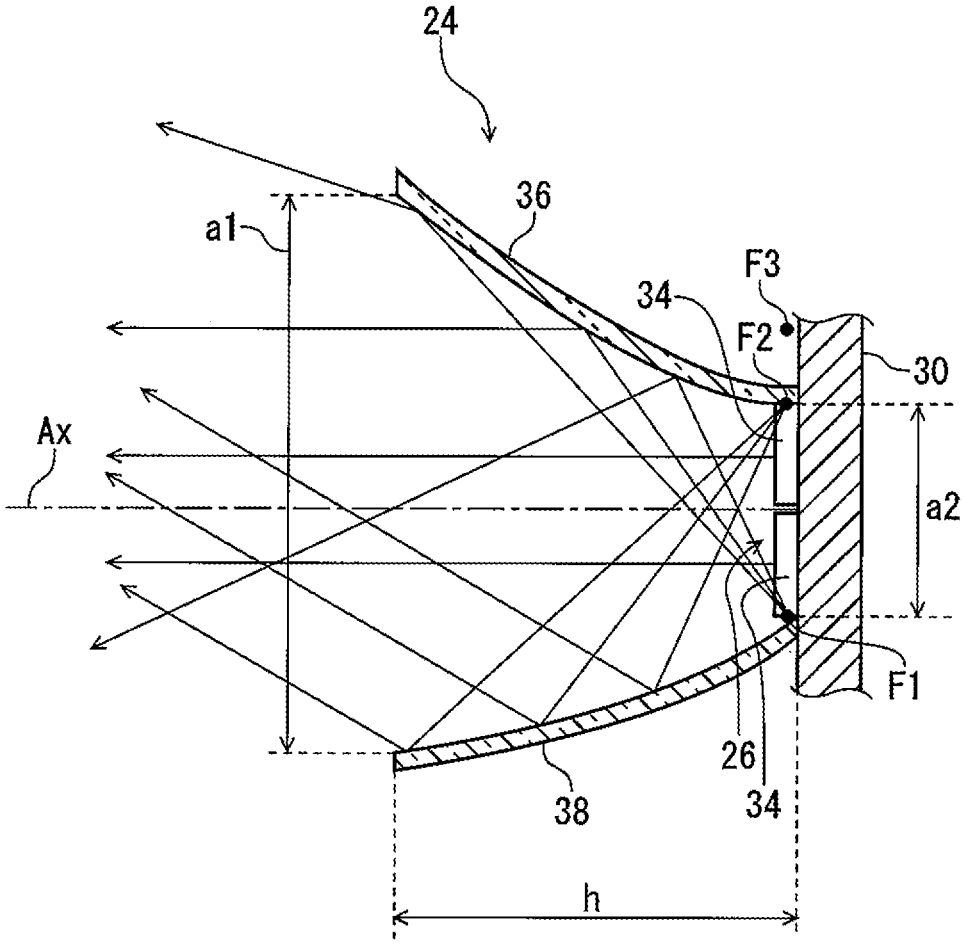
FIG. 8 is a front view of a modified example of a light source unit.

FIG. 8 also shows a modified example of a light source unit. This light source unit is also mounted in the high-beam lamp unit 20H shown in FIG. 1.

The light source unit 24 shown in FIG. 8 differs from the light source unit shown in FIG. 2 in that an upper reflecting mirror 36 provided above an LED array 26 is a hyperbolic cylindrical reflecting mirror. A lower reflecting mirror 38 provided below the LED array 26 is a parabolic cylindrical reflecting mirror which is similar to that of the light source unit shown in FIG. 2. In FIG. 8, focal points F1 and F3 are focal points of a hyperbolic surface of the upper reflecting mirror 36, and a focal point F2 is a focal point of a parabolic surface of the lower reflecting mirror 38. As is shown in FIG. 8, the focal point F1 is situated at a lower end portion of the LED array 26, and the focal point F2 is situated at an upper end portion of the LED array 26.

In the light source unit 24 shown in FIG. 8, when assuming that a distance between a distal end portion of the upper reflecting mirror 36 and a distal end portion of the lower reflecting mirror 38 is a1, a distance between a rear end portion of the upper reflecting mirror 36 and a rear end portion of the lower reflecting mirror 38 is a2, and a distance from the distal end portion of the upper reflecting mirror 36 (or the lower reflecting mirror 38) to the rear end portion of the upper reflecting mirror 36 (or the lower reflecting mirror 38) is h, the respective parameters can be set as follows: a1=4.5 mm, a2=1.8 mm, h=3.2 mm.

The upper reflecting mirror 36 and the lower reflecting mirror 38 reflect light from the LED array 26 towards a projection lens (not shown). As is shown in FIG. 8, part of light from the LED array 26 is not reflected on the upper reflecting mirror 36 and the lower reflecting mirror 38 but is directly incident on the projection lens. In addition, another part of light from the LED array 26 is reflected on the upper reflecting mirror 36 and the lower reflecting mirror 38 and is then incident on the projection lens 22. Consequently, the projection lens projects the direct light from the LEDs 34 and the reflected light reflected on the upper reflecting mirror 36 and the lower reflecting mirror 38 to the front. In this modified example, too, the respective LEDs 34 of the LED array 26 are controlled individually so as to be turned on and off by a control unit, not shown.

FIGS. 9A to 9F show light distribution patterns which are formed by a high-beam lamp unit which employs the light source unit shown in FIG. 8.

Figure 9A:
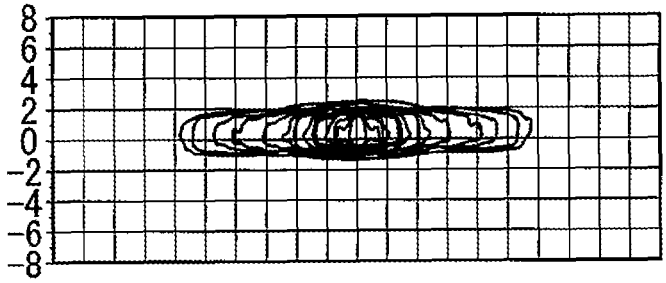
FIGS. 9A to 9F show light distribution patterns formed by a high-beam lamp unit which employs the light source to unit shown in FIG. 8.

FIG. 9A shows, as a comparison example, a high-beam light distribution pattern which is formed by a high-beam lamp unit using a light source unit which is realized by removing the upper reflecting mirror 36 and the lower reflecting mirror 38 from the light source unit 24 shown in FIG. 8. A vertical width of this high-beam light distribution pattern is defined as lying from about 2.5 degree to about −1.5 degree.

Figure 9B:
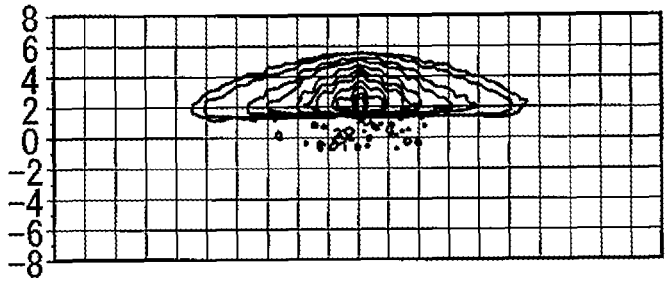

FIG. 9B shows a high-beam light distribution pattern which is formed by a high-beam lamp unit using a light source unit which is realized by removing the upper reflecting mirror 36 from the light source unit 24 shown in FIG. 8 with only the lower reflecting mirror 38 kept attached thereto. A vertical width of this high-beam light distribution pattern is defined as lying from about 4.7 degree to about −1.5 degree.

Figure 9C:
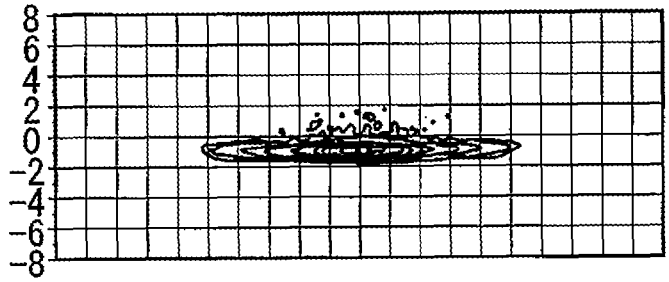

FIG. 9C shows a high-beam light distribution pattern which is formed by a high-beam lamp unit using a light source unit which is realized by removing the lower reflecting mirror 38 from the light source unit 24 shown in FIG. 8 with only the upper reflecting mirror 36 kept attached thereto. A vertical width of this high-beam light distribution pattern is defined as lying from about 0 degree to about −2 degree.

Figure 9D:
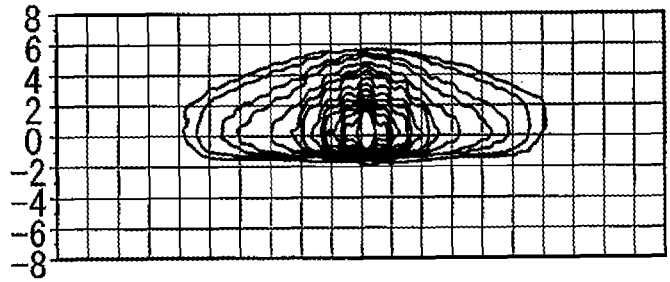

FIG. 9D shows a high-beam light distribution pattern which is formed by a high-beam lamp unit which employs the light source unit shown in FIG. 8. A vertical width of this high-beam light distribution pattern is defined as lying from about 5.7 degree to about −2.0 degree. It is seen that the illumination range of the high-beam light distribution pattern is increased, compared with the comparison example shown in FIG. 9A.

Figure 9E:
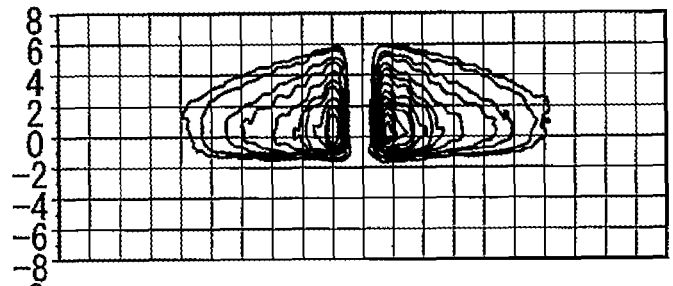

FIG. 9E shows a split light distribution pattern which is formed when four LEDs 34 which are situated near an optical axis Ax are turned off, while the remaining LEDs 34 are kept turned on. It is seen that a clear split light distribution pattern similar to that shown in FIG. 4D can also be formed when the light source unit 24 according to this modified example is used.

Figure 9F:
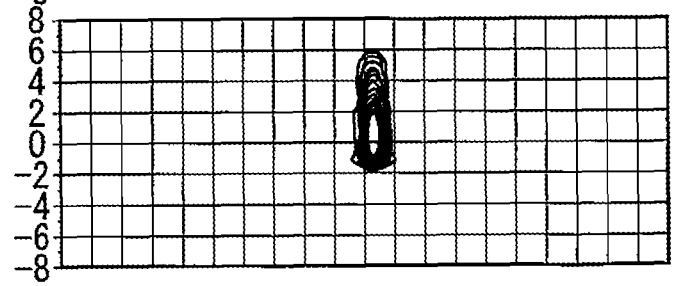

FIG. 9F shows a light distribution pattern which is formed when only portions of the two vertically aligned rows of LEDs 34 which are situated near the optical axis Ax are turned on. A desired light distribution pattern can be formed by turning on and off the LEDs 34 as required.

Thus, the invention has been described based on the embodiment. It is understood by those skilled in the art to which this invention pertains that the embodiment and modified examples which have been described depict the invention in an exemplary fashion, that the constituent elements and operational processes can be combined variously as modified examples and that these modified examples also fall within the scope of the invention.

Although the LEDs are used as the light source in the embodiment described above, the invention is not limited thereto, and hence, various types of light sources can be adopted. In addition, although the projection lens is depicted as the optical member which projects the direct light from the LEDs and the reflected light reflected on the reflecting mirrors to the front in the embodiment, the invention is not limited thereto, and hence, various types of optical members having a similar function to that of the projection lens can also be adopted.

What is claimed is:

1. A lamp unit comprising:

a light source array comprising a plurality of light sources aligned into an array;

a mount portion on which the light source array is to be mounted;

a first reflecting mirror configured to reflect light from the light sources, wherein the first reflecting mirror is parabolic cylindrical or hyperbolic cylindrical and is provided at least either above or below the light source array; and an optical member configured to project direct light from the light sources and reflected light from the first reflecting minor to the front, wherein the light source array is configured to be turned on and off with respect to each of the light sources.

2. The lamp unit of claim 1, further comprising a second reflecting mirror configured to reflect light from the light sources, wherein the second reflecting mirror is provided to at least either the left and right of the light source array.

3. The lamp unit of claim 1, wherein the light source array is formed so that the number of light sources which are disposed in a vertical direction therein becomes the largest near a center in a horizontal direction thereof.

4. The lamp unit of claim 2, wherein the light source array is formed so that the number of light sources which are disposed in a vertical direction therein becomes the largest near a center in a horizontal direction thereof.

5. The lamp unit of claim 2, wherein the light source array is configured to be turned on and off with respect to each of the light sources.

6. The lamp unit of claim 3, wherein the light source array is configured to be turned on and off with respect to each of the light sources.

7. The lamp unit of claim 4, wherein the light source array is configured to be turned on and off with respect to each of the light sources.

8. The lamp unit of claim 1, the first reflective minor is disposed between the light source array and the optical member.

9. The lamp unit of claim 1, wherein the light source array is disposed further rearwards than a rear focal point of the optical member.

10. The lamp unit of claim 1, further comprising:

a holder that holds the light source array and the optical member.

11. The lamp unit of claim 1, wherein the first reflecting mirror is fixed to the mounting portion.

12. The lamp unit of claim 1, wherein the first reflecting mirror is provided below the light source array.

13. The lamp unit of claim 1, further comprising:

a second reflecting mirror which is parabolic cylindrical or hyperbolic cylindrical, the first reflecting mirror is provided above the light source array, and the second reflecting mirror is provided below the light source array.

14. The lamp unit of claim 13, wherein a rear end portion of the first reflecting minor is in abutment with an upper end portion of the light source array, and a rear end portion of the second reflecting mirror is in abutment with a lower end portion of the light source array.

15. The lamp unit of claim 13, wherein the second reflecting mirror is the parabolic cylindrical, and a focal point of the second reflecting minor is situated at an upper end portion of the light source array.

16. The lamp unit of claim 15, wherein the first reflecting mirror is the parabolic cylindrical, and a focal point of the first reflecting minor is situated at a lower end portion of the light source array.

17. The lamp unit of claim 15, wherein the first reflecting mirror is the hyperbolic cylindrical, and one of focal points of the first reflecting mirror is situated at a lower end portion of the light source array.

18. The lamp unit of claim 13, wherein the following expressions are satisfied:

$$a1/a2=1/\sin\theta$$

$$h=a1\times1+\sin\theta/2\tan\theta$$

where a1 denotes a distance between a distal end portion of the first reflecting minor and a distal end portion of the second reflecting mirror, a2 denotes a distance between a rear end portion of the first reflecting minor and a rear end portion of the second reflecting minor, h denotes a distance, in an optical axis direction of the light source array, between the distal end portion of the first reflecting minor and the rear end portion of the first reflecting minor, and θ denotes an angle between an optical axis of the light source array and an optical axis of the first reflecting mirror.

19. A vehicle headlamp comprising:

the lamp unit of claim 1.

* * * * *